United States Patent [19]

Nakanishi et al.

[11] 4,388,617

[45] Jun. 14, 1983

[54] FIRE ALARM DEVICE HAVING THERMAL SENSITIVITY ENHANCEMENT

[76] Inventors: Yoshitaka Nakanishi, 12-9, Yawata 5-chome; Hiroshi Nakanishi, 16-18, Yawata 6-chome, both of Ichikawa-shi, Chiba-ken; Takashi Nakanishi, c/o Suzue Yamakawa, 1-11, Kandaizumi-cho, Chiyoda-ku, Tokyo, all of Japan

[21] Appl. No.: 278,456

[22] Filed: Jun. 29, 1981

[30] Foreign Application Priority Data

Dec. 16, 1980 [JP] Japan ..... 55-176530

[51] Int. Cl.[3] ..... G08B 17/06; G08B 21/00

[52] U.S. Cl. ..... 340/594; 337/380; 340/384 E; 340/584; 340/636; 340/693

[58] Field of Search ..... 340/594, 584, 586, 636, 340/693, 384 E; 337/380, 333

[56] References Cited

U.S. PATENT DOCUMENTS

| | | | |
|---|---|---|---|
| 3,297,845 | 1/1967 | Mertler | 337/380 |
| 3,392,380 | 7/1968 | Fordyce | 340/594 |
| 3,605,057 | 9/1971 | Mamiya | 337/380 |
| 3,872,470 | 3/1975 | Hoerz et al. | 340/384 E |
| 3,892,930 | 7/1975 | Wieder | 340/628 |
| 3,932,849 | 1/1976 | Welch | 340/595 |
| 3,995,268 | 11/1976 | Ferrari | 340/384 E |
| 4,258,359 | 3/1981 | McLamb | 340/693 |

*Primary Examiner*—Glen R. Swann, III

*Attorney, Agent, or Firm*—Robert E. Burns; Emmanuel J. Lobato; Bruce L. Adams

[57] ABSTRACT

A fire alarm device has, in a main body, a fire detection means and alarm means controllable by a detection signal from the fire detection means. The fire alarm device, which being independent in itself is installed on a ceiling or wall where the fire can be easily detected and produces an acoustic alarm as soon as the fire is detected. The detection element of the fire detection means is provided in front of a speaker for producing the acoustic alarm. Since the heat due to the fire is concentrated in front of the speaker, the detection element can react quickly.

18 Claims, 11 Drawing Figures

FIRE ALARM DEVICE HAVING THERMAL SENSITIVITY ENHANCEMENT

BACKGROUND OF THE INVENTION

The present invention relates to a fire alarm device, and more particularly to a device which can be used at home or office in a handy manner.

Various systems which detect a fire and produce alarms are already known. In many cases, these systems have been used for buildings, for example, hotels, schools and other large facilities. The sensing means are arranged in corridors or rooms, wherein the sensing means are connected to a central control instrument in a control room by means of many wirings. When respective sensing means detects the fire, the sensing means delivers a detection signal to the central control instrument so as to announce the fire. Such systems are quite suited for hotels, schools, or facilities having many rooms, but are not economical for private houses or small offices.

SUMMARY OF THE INVENTION

An object of the present invention is to provide a fire alarm which can be easily installed in many private houses and the like which have not so far been taken into consideration.

Another object of the present invention is to provide a fire alarm device of simple construction, comprising a heat sensing plate, which can detect the fire in the early stage.

Still another object of the present invention is to provide a fire alarm device which can be easily arranged and inspected.

According to the present invention, a fire alarm device is provided with a main body to be mounted at places where fire can be easily sensed, an alarm means for producing the acoustic alarm, and a fire sensing means for delivering a fire detection signal to the alarm means. A speaker for producing the acoustic alarm from the alarm means is positioned on the front side in the main body, while fire sensing means is positioned in front of the speaker. Fire sensing means preferably includes a heat sensing plate, which is provided with communicating openings for accelerating the passage of the hot air stream.

Embodiments of the present invention will be described by way of example with reference to the accompanying drawings.

DESCRIPTION OF THE PREFERRED EMBODIMENTS

Figure 1:
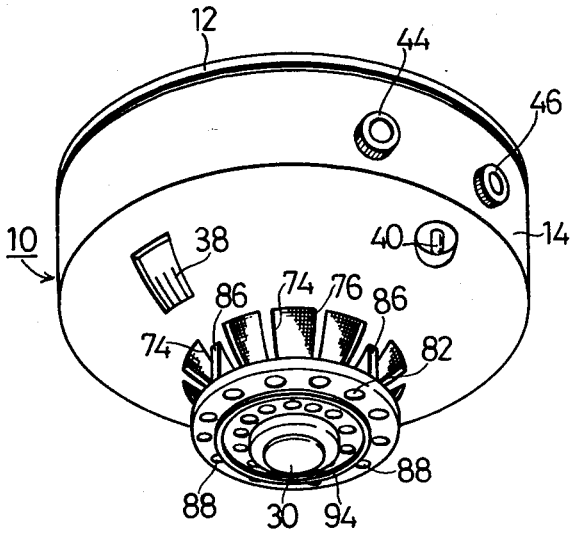
FIG. 1 is a perspective view of a fire alarm device according to the present invention.
Figure 3:
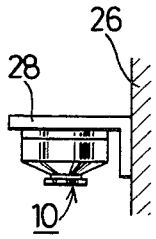
FIG. 3 is a side view of another embodiment installed on a wall.

In FIG. 1 to FIG. 5, the main body 10 comprises a stationary body 12 and a movable body 14 detachably mounted on the stationary body. Around the stationary body, a male screw 16 is provided, which engages in the female screw 18 provided on the movable body. An O-ring 20 is provided between the stationary body and the movable body. However, these bodies may be connected by fitting into each other. The main body is installed by means of wood screws or double sided adhesive tapes 22 on ceilings 24, wall 26 or other places, where the hot air stream caused by a fire can be easily detected. Further, the main body may be installed on a wall by means of an L-shaped bracket 28. The movable body is provided with an acoustic alarm means and a fire detection means.

Figure 6:
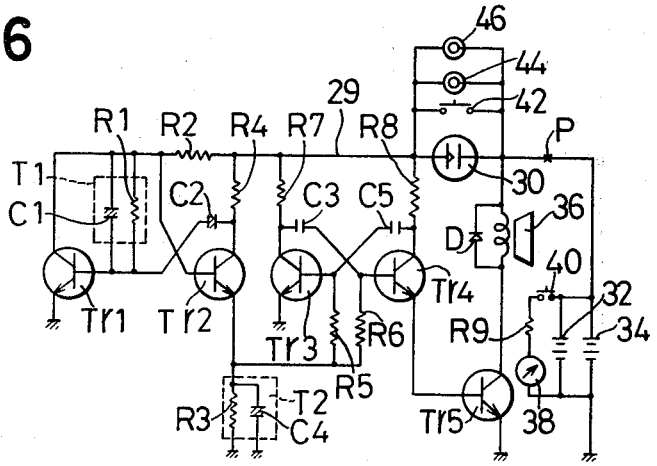
FIG. 6 is an electrical circuit of the fire alarm device according to the present invention.

FIG. 6 shows an electrical circuit for alarm means. Alarm means comprises an oscillating circuit, a control circuit for intermittently controlling the operation of the oscillating circuit, a fire detection element for controlling the above element so as to operate at the time of the fire, an amplifier for amplifying an output signal of the oscillating circuit and a speaker for converting the signal amplified by means of the amplifier into the acoustic alarm.

In the oscillating circuit, the astable multivibrator including transistors Tr3 and Tr4 is used. The collector of the transistor Tr3 and that of the transistor Tr4 are connected to a lead 29 which is the common voltage supply line, through the respective resistors R7, R8. Further, the collector of the transistor Tr3 is coupled to the base of the transistor Tr4 through the capacitor C3. The collector of the transistor Tr4 is coupled to the base of the transistor Tr3 through the capacitor C5. The emitter of the transistor Tr3 is directly grounded. The emitter of the transistor Tr4 is connected to the base of the transistor Tr5 as explained later. This astable multivibrator produces an audible frequency signal of, for example, about 700 Hz.

The control circuit for intermittently controlling the operation of the astable multivibrator includes the transistors Tr1 and Tr2. The emitter of the transistor Tr2 is grounded through the time constant circuit T2 consisting of a resistance R3 and a capacitor C4 and connected to the bases of the transistors Tr3 and Tr4 through the resistances R5, R6 respectively. The base of the transistor Tr2 is connected to the collector of the transistor Tr1 and then to the lead 29 through a common resistor R2. The collector of the transistor Tr2 is connected to the lead 29 through the resistance R4 and then to the base of the transistor Tr1 through the capacitor C2. Between the base and the collector of the transistor Tr1, a time constant circuit T1 consisting of a resistance R1 and a capacitor C1 is connected. The emitter of the transistor Tr1 is directly grounded. In the fire detection means a bimetal system fire detection element 30 is adopted. The fire detection element is connected between the lead 29 and the positive terminals of the batteries 32 and 34. As the fire detection means, a thermister, a ballister and other semiconductor elements may be adopted.

The amplifier circuit consists of the transistor Tr5. The collector of the transistor Tr5 is connected to the positive terminals of the batteries 32 and 34 as the power source through the speaker 36. The negative terminals of the batteries are grounded. The base of the transistor Tr5 is connected to the emitter of the transistor Tr4 as mentioned above.

When a fire is detected by means of the fire detection element 30, a current is supplied to the astable multivibrator and the control circuit from the batteries 32 and 34. When a voltage is applied to the base of the transistor Tr2 through the resistance R2, the transistor Tr2 becomes conductive. The capacitors C1 and C2 are gradually charged through the resistance R4. When along with the charge of the capacitors, the base voltage of the transistor Tr1 becomes higher than the threshold level, the transistor Tr1 is brought into the conductive state. As a result, the transistor Tr2 is cut off. The capacitor C4 is sufficiently charged before the transistor Tr2 becomes conductive and then cut off. When the transistor Tr2 is cut off, the capacitor C4 is gradually discharged through the resistance R3, whereby the terminal voltage across the capacitor C4 is gradually decreased. When it reaches a certain determined level, the astable multivibrator starts to oscillate. During this time, the capacitor C1 is discharged through the resistance R1, while the transistor Tr1 is cut off after the lapse of a certain determined time. As a result, a voltage is again applied to the base of the transistor Tr2 through the resistance R2, so that the transistor Tr2 is brought into the conductive state. Thus, the terminal voltage across the resistor R3 increases and the astable multivibrator stops the operation. The operation is repeated while the fire detection element is detecting the fire, the intermittent oscillation signals from the astable multivibrator are amplified by means of the transistor Tr5 and produced as the acoustic alarm from the speaker 36.

The oscillation frequency of the astable multivibrator is almost determined by the time constant of the resistance R6 and the capacitor C3 and that of the resistance R5 and the capacitor C5. When the time constant of the resistance R6 and the capacitor C3 is chosen differently from that of the resistance R5 and the capacitor C5, the tone of the acoustic alarm is conveniently changed. Further, the emitter of the transistor Tr4 is grounded through the base of the transistor Tr5, so that it is advantageous if the value of the collector resistor R8 of the transistor Tr4 is chosen somewhat smaller than that of the collector resistor R7 of the transistor Tr3 in such a manner that the voltage drop between the base and the emitter of the transistor Tr5 is compensated.

Two batteries 32 and 34 are connected in parallel to each other in order to avoid the drop of terminal voltage of the batteries. There is provided a check means consisting of an ampere meter 38, the voltage dividing resistance R9 and the switch 40 connected in series with each other. Whenever the switch is closed, the battery voltage can be checked by means of the ampere meter. Further, when checking whether each circuit of the alarm means operates normally, the switch 42 is connected in parallel to the fire detection element.

The wiring is carried out in such a manner that the current flowing through the transistor Tr5 does not flow through the fire detection element so that even a fire detection element with small maximum current capacity may be used. If, however, a fire detection element with large maximum current capacity is used, the detection element may be connected to the node identified by the point P in the drawing. A diode D connected in parallel to the driving coil of the speaker 36 serves to protect the transistor Tr5.

Figure 7:
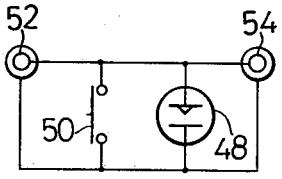
FIG. 7 is an electrical circuit of the device with a fire detection means.

The jacks 44 and 46 serve to electrically connect slave devices provided at a place apart from the main body such as in another room or a different floor. The slave device having the circuit shown in FIG. 7 is provided with the fire detection element 48, the operation check switch 50, the jack 52 similar to that of the main body and the jack 54 for connecting the device to another slave device. The electrical circuit consists of transistors, resistances and capacitors connected as discrete elements, or it can be constructed with FET or linear integrated circuits so as to effect the same functions as mentioned above.

Figure 4:
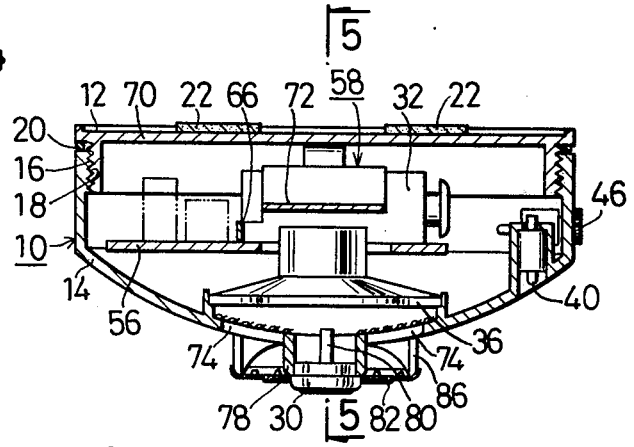
FIG. 4 is a longitudinal sectional view of the fire alarm device according to the present invention.
Figure 5:
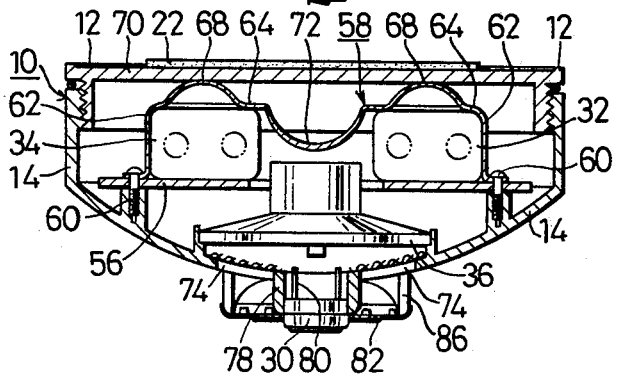
FIG. 5 is a sectional view along the line 5—5 of FIG. 4.

The parts constituting the alarm means are provided on the board 56 supported in the main body. As a power source, the batteries 32 and 34 are mounted on the board and fixed by means of the belt 58. The batteries consist of two dry batteries of 9 V, however, other batteries can be used in accordance with the circuit. The belt for allowing the exchange of the batteries is preferably formed with polypropylene or other elastic material. The belt is fixed at both ends on the main body together with the board, including the side walls 62 along the sides of the batteries, the upper walls 64 covering the upper sides of the batteries and the rear walls 66 along the rear sides of the batteries (FIGS. 4 and 5). The middle portion of the upper walls make projections 68 arched upwards so as to be in elastic contact with the top plate 70 of the stationary body when the movable body is engaged on the stationary body. With the fact that the projection is in contact with the top plate, the batteries are in still more close contact with the board. The inner ends of the upper walls at both sides are hinged together by means of a downwardly bowed portion 72. The bowed portion can be bent upwardly. In this state, the upper wall will separate from the batteries so that the batteries can be easily taken out from the belt.

Figure 8:
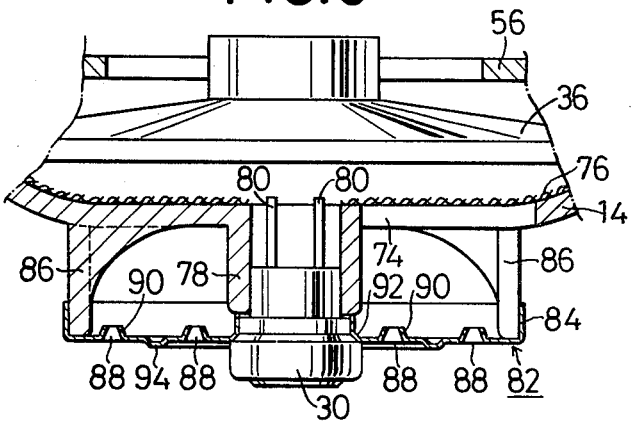
FIG. 8 is an enlarged sectional view, showing mainly a thermal detection plate part.

In the front side within the movable body, the speaker 36 is provided. The speaker is preferably one having a diaphragm such as a cone speaker. The front side of the main body is provided with openings 74 for radiating the acoustic alarm outwards. Inside of the main body, protection against humidity is provided by layer 76 such as cloth impregnated with silicon and the like (FIG. 8). When the diaphragm of the speaker is made of metal or plastic materials, a protection layer can be omitted. Because the speaker is provided on the front side of the main body, the heat arising from a fire is easily gathered in front of the speaker.

The fire detection means is provided in front of the speaker, where the heat is easily gathered as mentioned above. The fire detection element 30 is, preferably fixed with adhesive, put in the cylindrical support 78 provided in the main body. The terminals 80,80 of the detection element are connected to the predeterminate portions of the alarm means by wiring (not shown). The casing of the fire detection element preferably consists of metal such as aluminium so as to increase the heat sensing effect. The casing is preferably encircled with heat sensing plate 82.

Figure 9:
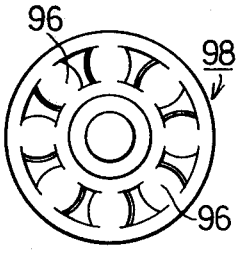
FIG. 9 is a plan view, showing another embodiment of the thermal detection plate.

As shown in FIG. 8, the heat sensing plate is made of highly heat-conductive material such as aluminium or others and is supported by attaching the flange 84 provided around the plate on the pillars 86 provided on the main body. The sensing plate has many openings 88, around which guide cylinders 90 directed to the speaker are provided. The guide cylinders are preferably smaller in diameter toward the speaker. When the hot air stream flows through the openings, the stream is accelerated, so that the temperature of the heat sensing plate is raised rapidly. The internal flange 92 provided almost at the center of the heat sensing plate is in close contact with the casing of the fire detecting element in such a manner that the heat received by the heat sensing plate is transmitted to the detection element effectively. The rib 94 is provided in ring shape almost in the middle of the plate. The sensing plate can easily be obtained by pressing a sheet metal such as aluminium. Thus the resulting sensing plate has a larger surface area than a flat plate and therefore is heated more rapidly. Further, the heat sensing plate 98 having a number of blades 96 punched out of a plate and bent like propellers may be also used (FIG. 9).

Figure 10:
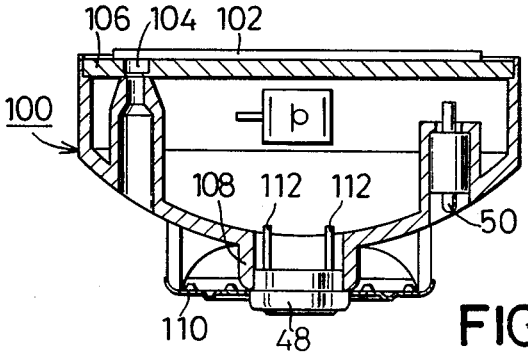
FIG. 10 is a sectional view of a device with the fire detection means.
Figure 11:
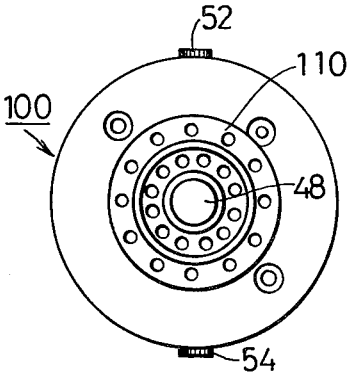
FIG. 11 is a front view of the device with the fire detection means shown in FIG. 10.

The alarm means may be operated by means of the detection signal from a plurality of the fire detection means. FIG. 10 and FIG. 11 show preferred embodiments of the device having sensing means provided apart from each other so as to detect the fire at different places. The main body 100 comprises a back plate 106 having a double sides adhesive tape 102 and a screw hole 104 for mounting. In the cylindrical support 108 in front of the main body, the fire detection element 48 and the heat sensing plate 110 are provided. These elements are mounted in the above mentioned manner. The check switch 50 for the check means is provided and the terminals of the switch are connected to the jacks 52 and 54 together with the terminal 112 of the fire detection element by means of conductors (not shown). Two jacks are provided and, therefore, when the plurality of fire detection means are connected in series with the jacks, the fires taking place at the different places can be detected so as to operate the alarm means.

Figure 2:
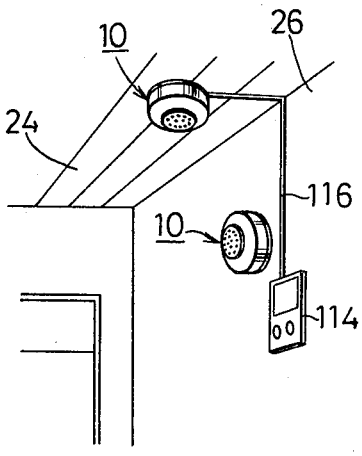
FIG. 2 is a perspective view of the fire alarm device according to the present invention, illustrating the fire alarm installed on a ceiling or wall.

In FIG. 1 and in embodiments shown in other Figs., the check means is housed in the main body. However, the ampere meter 38 and the switch 40 can be provided apart from the main body. For example, as shown in FIG. 2, the box 114 having the ampere meter and so on is mounted on the wall 26 and is easily accesible and connected to the main body by means of wiring 116. Further, when the batteries are contained in the box, they can be exchanged easily.

The present invention has been clearly explained above with reference to preferred embodiments thereof, it will be understood that many other variations and improvements can be made without departing from the spirit of the present invention. For example, the power supply containing a rectifier is housed in the main body in such a manner that the current is obtained from an alternating current source, or the power supply for obtaining the direct current source from the alternating current source is provided apart from the main body and connected to the main body with wires. Further, the power supply may be used in common with the batteries.

What is claimed is:

1. A fire alarm device, comprising:

a case comprising a main body portion to be mounted stationary and a removable body portion which can be removed from the main body portion, said removable body portion having openings on the front side thereof;

fire sensing means for sensing fire, said fire sensing means comprising a fire detecting element and a heat sensing plate, and said fire sensing means being mounted on said case in front of the openings of the removable body portion; and alarm means including a loudspeaker for issuing an acoustic alarm from said loudspeaker in response to a detection signal from the fire sensing means, said loudspeaker having a conical diaphragm and said loudspeaker is mounted behind the openings of the removable body portion with said conical diaphragm facing the openings.

2. A fire alarm device according to claim 1, wherein the fire sensing means is a bimetal fire detecting element having a heat sensing plate.

3. A fire alarm device according to claim 2, wherein the heat sensing plate has a plurality of holes therethrough, and a respective guide cylinder formed around each of the holes and directed toward the speaker.

4. A fire alarm device according to claim 3, wherein the guide cylinder is formed with a decreasing diameter along the direction toward the speaker.

5. A fire alarm device according to claim 1, 2, 3 or 4, wherein the alarm means includes an oscillation circuit for producing an audible frequency signal, a control circuit for controlling the oscillation circuit to intermittently operate, and an amplifier circuit for amplifying the output of the oscillation circuit and for applying the amplified output to drive the speaker, and wherein the current supply to the oscillation circuit and the control circuit is controlled by means of the fire sensing means.

6. A fire alarm device according to claim 5, wherein the amplifier circuit includes a transistor, wherein the oscillation circuit and the control circuit respectively include a pair of transistors, and wherein the emitter of the one transistor of the control circuit is connected to the base of each transistor of the oscillation circuit by means of respective resistances and returned to the power source through a time constant circuit, a second time constant circuit is connected between the collector and the base of the other transistor of the control circuit, and the collector is connected to the base of the one transistor of the control circuit, and the collector of the one transistor of the control circuit is connected to the base of the other transistor of the control circuit through a capacitor.

7. A fire alarm device according to claim 1, further comprising a battery for powering the fire alarm device, and battery checking means for checking the condition of said battery, said battery checking means being provided on the main body portion of the case.

8. A fire alarm device according to claim 1, further comprising a battery for powering the fire alarm device, and battery checking means for checking the condition of said battery, said battery checking means being provided remote from the main body portion of the case.

9. A fire alarm device according to claim 1, wherein the main body portion is configured to be installed on a ceiling, a wall or the like, and the battery checking means and a battery are positioned remote from the main body.

10. A fire alarm device according to claim 1, wherein the main body portion is configured to be mounted on a ceiling, a wall or the like, the removable body portion is detachably mounted on the stationary body portion, and the alarm means for issuing the acoustic alarm, the fire sensing means for delivering the fire detection signal to the alarm means and a power source for operating the alarm means and the fire sensing means are housed within the removable body portion.

11. A fire alarm device according to claim 10, wherein the alarm means is operated by means of the detection signals from a plurality of fire sensing means provided at suitable positions whereby the fire at different places can be detected.

12. A fire alarm device according to claim 10, said heat sensing plate including a plurality of openings dimensioned to accelerate the passage of a hot air stream in such a manner that the heat sensing plate can be heated rapidly by means of a hot air stream caused by a fire.

13. In a fire alarm device, the combination comprising:

a case having an opening therethrough;

a heat sensing element;

mounting means for mounting said heat sensing element proximate the opening through said case; and a partition within said case for defining a compartment within said case at the opening through said case to accumulate within the compartment warm air which flows through the opening for accelerating heating of said heat sensing element by the warm air.

14. In a fire alarm device according to claim 13, a loudspeaker having a loudspeaker diaphragm, and speaker mounting means for mounting said loudspeaker within said case in a position with said loudspeaker diaphragm constituting said partition defining a compartment within said case.

15. In a fire alarm device according to claim 13 or 14, a thermally conductive plate covering the hole through said case and contacting said heat sensing element to transfer heat thereto, said thermally conductive plate disposed covering the hole through said case, and said thermally conductive plate having holes therethrough to permit air to flow through the holes and into said compartment for accumulating warm air to heat said heat sensing element.

16. In a fire alarm device according to claim 15, said thermally conductive plate includes a plurality of tubular protrusions each surrounding a respective one of the holes through said thermally conductive plate and having an internal diameter converging in a direction toward the compartment within said case for accelerating warm air which flows through the holes through said thermally conductive plate toward the opening through said case for accumulation within the compartment in said case.

17. In a fire alarm device according to claim 13 or 14, said case comprising two sections releasably connectable for connecting to assemble said case and for releasing to disassemble said case, a first section of said case having means for attaching the case first section to a surface, the second section of said case having the opening through said case, and said mounting means mounting said heat sensing element on the second section of said case.

18. In a fire alarm device according to claim 17, a thermally conductive plate covering the hole through said case and contacting said heat sensing element to transfer heat hereto, said thermally conductive plate disposed covering the hole through said case, and said thermally conductive plate having holes therethrough to permit air to flow through the holes and into said compartment for accumulating warm air to heat said heat sensing element.

* * * * *